United States Patent [19]

Harlick et al.

[11] Patent Number: 4,676,554

[45] Date of Patent: Jun. 30, 1987

[54] ARTICLE FOR RESTRAINING AND SUPPORTING HUMANS, PRIMARILY CHILDREN, IN A CHAIR

[76] Inventors: Allan J. Harlick; Susan W. Harlick, both of 20904-82nd Ave. West, Edmonds, Wash. 98020

[21] Appl. No.: 803,395

[22] Filed: Dec. 2, 1985

[51] Int. Cl.[4] ..... A47C 31/00

[52] U.S. Cl. ..... 297/467; 297/465

[58] Field of Search ..... 297/465, 467, 464

[56] References Cited

U.S. PATENT DOCUMENTS 2,302,710 11/1942 Nordblom ..... 297/465
2,767,403 10/1956 Givens ..... 297/465 X
3,125,373 3/1964 Boatman ..... 297/465
3,713,692 1/1973 McCracken et al. ..... 297/467

FOREIGN PATENT DOCUMENTS 2229199 12/1974 France ..... 297/465

*Primary Examiner*—James T. McCall

[57] ABSTRACT

An article comprising a substantially heart-shaped section of fabric (10) having a plurality of severance lines (22,24,26,28,32,34) extending from a first severance line (20) which is located at the midpoint of the top edge (12) of the article, the severance lines defining three sets of tie bands, two sets being used to tie the article to a chair and the other set being used to restrain a person.

12 Claims, 6 Drawing Figures

ARTICLE FOR RESTRAINING AND SUPPORTING HUMANS, PRIMARILY CHILDREN, IN A CHAIR

DESCRIPTION

1. Technical Field

This invention relates generally to the art of physical restraints/supports and more particularly is directed to such an article which is used to support children in a chair or other seating apparatus.

2. Background Art

The need for an article or device for restraint and support of children, particularly young children, in a chair, highchair, etc. is well known, and such articles are commercially available. Younger children in particular, who do not have a significant amount of bodily control, require assistance in maintaining themselves in an upright, stable position. However, it should be understood that the same need for support occurs in certain older children and even adults, who for various reasons need assistance in support while in a chair or similar article of seating.

Most such restraining articles comprise a combination of straps which buckle or tie the person to the chair. Such straps are seen on most commercially available high chairs. One strap is used around the child and that strap is then secured to other straps which in turn are attached to the chair itself. Other systems are more particularly adapted for support, such as shown in U.S. Pat. No. 3,713,692, titled "Harness For Restraining A Child In A Chair", in the name of McCracken et al. Such systems, however, are usually inconvenient to use.

Other systems of restraint/support include a combination of a rigid support structure with straps, such as infant seats and carseats for very young children. However, those devices are typically not adapted to be used with conventional chairs, and are relatively expensive.

Still other restraints have been developed which are simplier and less expensive than that shown in the McCracken reference, yet provide more support and greater stability that just a strap system. An example of such a restraint takes the form of a fabric section upon which the child is seated, with two sets of straps extending from the rear corners of the section which are tied to the chair, and two additional straps extending from the front of the fabric section which are used to tie around the child, and the chair back. The fabric section and the straps are cut from separate pieces of cloth and are sewed together. Such a restraint is also fairly expensive, although it does have the advantage of convenience, and provides more stability than just straps alone.

3. Disclosure of The Invention

Accordingly, the present invention is a restraint/support article which is useful with a chair or similar article such as a highchair, stroller or the like. The article includes a single-piece fabric section, wherein the fabric section includes a portion which is so configured as to permit the person or animal which is to be restrained, such as a young child for instance, to be seated thereon, and first and second strap means. The first strap means, which in use is severed from the remainder of the fabric section except in the vicinity of one end thereof, is adapted to secure the fabric section to the chair. The second strap means, which also in use is severed from the remainder of the fabric section, except in the vicinity of one end thereof, is adapted to secure the person to be restrained.

BEST MODE FOR CARRYING OUT THE INVENTION

Figure 1:
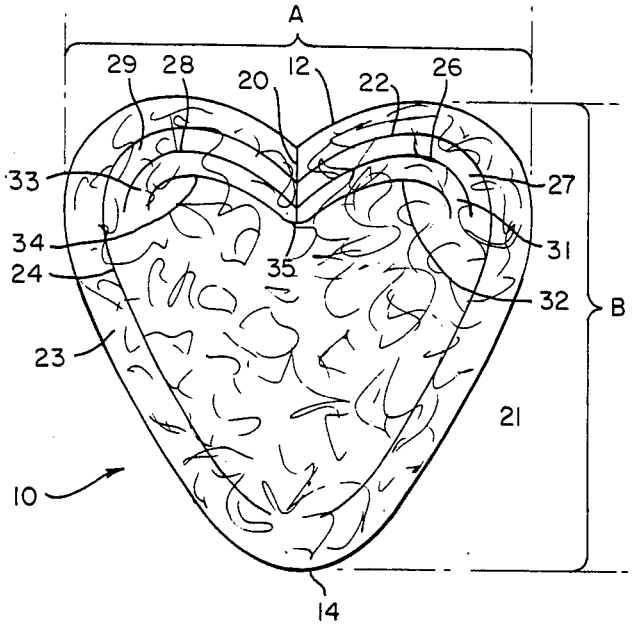
FIG. 1 is a top view of the restraint of the present invention showing the fabric section in one piece but with the several severance lines.

The present invention is an article of restraint and support, typically for a young child for use with a chair, which is made from a single piece of material, as shown in FIG. 1. The material could be a single fabric, or composites. The single fabric section 10 is configured so that the upper edge 12 is significantly wider than the lower edge 14, which in the embodiment shown terminates in a rounded point. In the embodiment of FIGS. 1–5, the fabric section 10 is in the shape of a heart. It should be understood, however, that the present invention is not limited to such a particular configuration, but in fact can take other similar configurations which provide similar results, including circular, elongated, and H-shaped, as a few examples.

The material of fabric section 10 in the embodiment shown is a single layer of high strength, non-raveling material, such as the spunbonded nylon marketed by Monsanto under the trademark Cerex. This fabric, in a relatively small thickness, i.e. approximately 5 mils, is capable of supporting young children weighing 20–30 lbs. Since the material is so thin, it can be easily packaged in substantial numbers, and several articles may be conveniently carried in a purse or pocket. Such a fabric section may be readily used with a wide variety of chair types. Such convenience is a significant advantage of the present invention. It should be understood however, that materials other than CEREX may be used in the present invention. Further, the fabric section 10 may be made in different thicknesses, or may comprise two or more layers secured together, or may be impregnated with a reinforcing agent, in order to increase its strength.

As mentioned above, the fabric section 10 has a heart-shaped outline, with dimension A being approximately $18\frac{1}{2}''$ in the embodiment shown, and dimension B being approximately 18". The fabric section 10, which is in one piece, is cut along the defined severance lines shown in FIG. 1. Severance line 20 is a vertical line extending approximately $2\frac{1}{8}''$ downwardly from the center of the upper edge 12 of the fabric section 10, i.e. along the line of symmetry in the heart-shaped section. The remaining severance lines extend from first severance line 20. The second and third severance lines 22 and 24 extend in opposite directions from first severance line 20 at a point which is approximately $1\frac{1}{4}''$ down from the upper edge 12 of fabric section 10.

Severance lines 22 and 24 follow the peripheral edge of the fabric section, in opposite directions, to respective termination points in the vicinity of the lower edge 14. In the embodiment shown, there is a distance of approximately 2" between the respective termination points of severance lines 22 and 24. The second and third severance lines 22 and 24 define a first pair of tie bands 21 and 23.

Fourth and fifth severance lines 26 and 28 extend from first severance line 20 at a point which is approximately ¾" below the second and third severance lines. The fourth and fifth severance lines extend in opposite directions from severance line 20, following the second and third severance lines for a relatively short distance, approximately 8"–9" in the embodiment shown, where they terminate. The fourth and fifth severance lines define third and fourth tie bands 27 and 29.

Sixth and seventh severance lines 32 and 34 extend from the bottom edge of first severance line 20 approximately ¾" below the fourth and fifth severance lines. The sixth and seventh severance lines extend in opposite directions from severance line 20 at point 35, which may be slightly rounded, and are approximately the same length as the fourth and fifth severance lines. The sixth and seventh severance lines define fifth and sixth tie bands 31 and 33. The width of the individual tie bands remains the same over substantially their entire length, or they may be slightly tapered. In the embodiment shown, the first and second tie bands are approximately 1½" wide, while the third through sixth bands are approximately ¾" wide. As mentioned above, the first and second tie bands form a first pair of tie bands; however, third and fifth tie bands form a second pair of tie bands, while the fourth and sixth tie bands form a third pair of tie bands.

Figure 2:
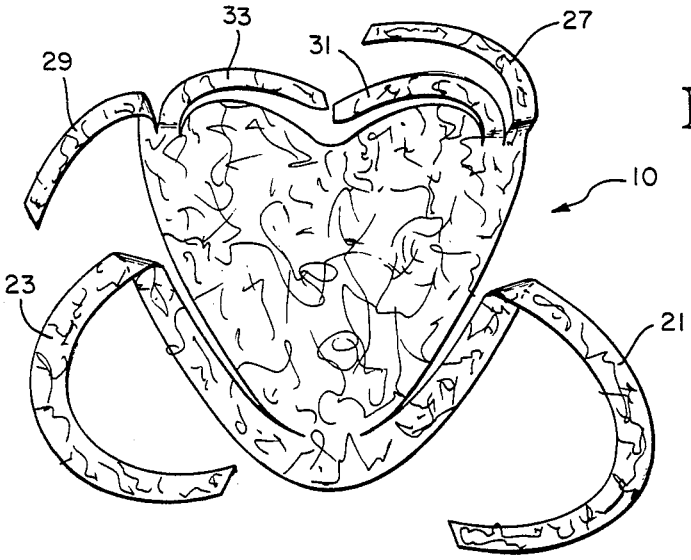
FIG. 2 shows the article of FIG. 1 with the severance lines of FIG. 1 cut and the resulting straps separated for clarity.

The fabric section 10 is cut along the severance lines, either by hand or by machine, so that the three pairs of tie bands are separated, or are readily separable, such as by tabs or perforations, from each other and from the remainder of the fabric section, such as shown pictorially in FIG. 2. After the cutting is completed, the product is ready for packaging and shipment.

Figure 3:
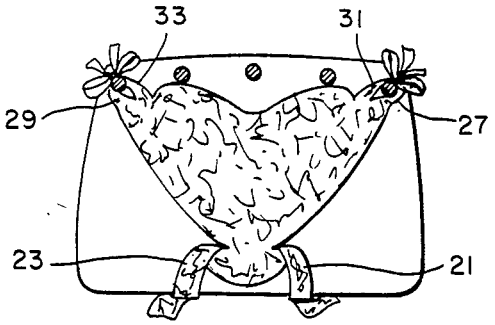
FIG. 3 shows the article of FIGS. 1 and 2 secured to a chair.

When the article is ready to be used by the consumer, it is placed on the seat of a chair, with the upper edge 12 of the fabric section 10 at the rear of the seat and the lower edge 14 at the front. The second set of tie bands 27 and 31 and the third set of tie bands 29 and 33 are then tied around the vertical rungs at the rear of the chain as shown in FIG. 3, so as to provide a stable positioning of the article on the chair.

Figure 4:
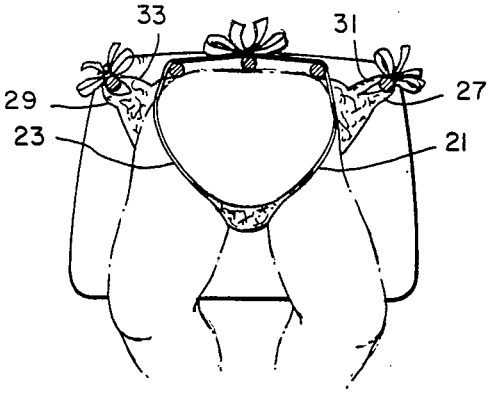
FIG. 4 shows the article of FIGS. 1–3 with a child in place and with the straps of the article secured around the child and the chair.
Figure 5:
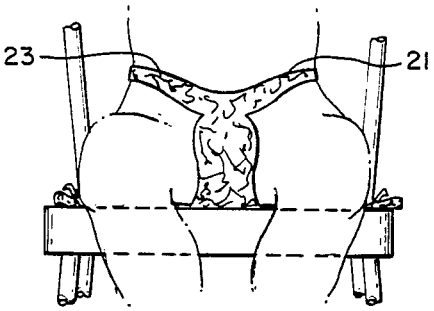
FIG. 5 is an elevational view of the subject matter of FIG. 4.

The person to be restrained is then placed on the remainder of the fabric section 10, with the first set of tie bands 21 and 23 extending outwardly between the legs of the person. The tie bands are then moved upwardly and around the waist of the person and tied securely at the back of the person, around the chair rungs, as shown in FIG. 4.

Thus, a secure restraint and support article for a person, such as a young child, is provided, with the article being relatively inexpensive, and very convenient to use and to store. Typically one article may be used a number of times, until disposal is convenient or necessary. The article can be used in various situations to provide the kind of restraint and support necessary for young children, and others requiring support assistance, in conventional chairs, highchairs, wheelchairs, strollers and the like, for application in the health care industry, veterinary industry, and other industries. The preferred embodiment uses tie bands which are tied by the consumer around the chair and the child. However, fasteners could also be used, such as velcro or tape, to secure one band to the other or one band to the main body of the fabric section or an extending tab.

Figure 6:
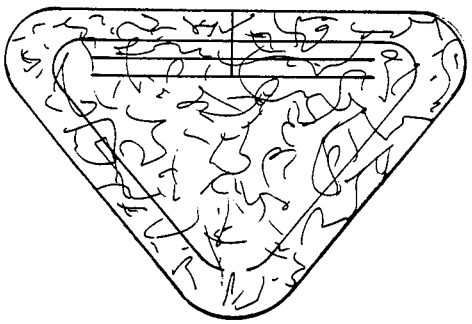
FIG. 6 shows an alternative embodiment to that of FIG. 1.

Although the embodiment as shown is heart-shaped, it should be understood, as pointed out above, that other configurations could be used. As an example, FIG. 6 is triangular shaped. More examples include other geometric shapes, animals, H or T shapes, company logo shapes, and others. The dimensions of the article may be changed proportionally to accommodate different people or animals using the article. Further, apertures may be included for special needs, such as urination.

Different materials may also be used for the fabric section. Examples include either natural or synthetic fiber or film-like materials, in the form of single piece sheets or compositions. The fabric section may be in different colors, textures, and patterns by printing or impregnation.

Although a preferred embodiment of the invention has been disclosed herein for illustration, it should be understood that still further changes, modifications and substitutions, other than outlined above, may be incorporated in such embodiment without departing from the spirit of the invention as defined by the claims which follow.

We claim:

1. An article of restraint/support for use with a chair or the like, comprising:

a single piece fabric section with a continuous peripheral edge, having a rear edge portion which is substantially wider than the front edge portion and intermediate edge portions which respectively connect the rear and front edge portions, wherein said fabric section is large enough to permit the person to be restrained to be seated on said fabric section with said fabric section covering a substantial portion of the person's bottom, said fabric section including first and second strap means located respectively in the vicinity of opposing corners of the rear edge portion of said fabric section, said first and second strap means each being in use severed from the remainder of said fabric section except in the vicinity of one end thereof and adapted to secure said fabric section to the chair, said fabric section further including third strap means located at the front edge portion of said fabric section, said third strap means being in use severed from the remainder of said fabric section except in the vicinity of one end thereof and adapted to secure the person to be restrained.

2. An article of claim 1, wherein said first, second and third strap means each comprise a pair of tie bands.

3. An article of claim 1, wherein said fabric section is approximately heart-shaped in outline.

4. An article of claim 1, wherein said third strap means is located approximately midway laterally between said first and second strap means.

5. An article of claim 1, wherein the material comprising the fabric section is non-raveling, having substantially equal strength in all directions.

6. An article of claim 1, wherein said fabric section may have a wide variety of outline configurations.

7. An article of claim 1, wherein the article is adapted for use with a wide variety of chairs.

8. An article of claim 1, wherein the article comprises such a material and is of such a size and configuration that it may be conveniently folded into a compact form.

9. An article of restraint/support for use with a chair, comprising:

a single-piece fabric section with a continuous peripheral edge, having a top edge which is subtantially wider than the bottom edge thereof, wherein the fabric section is large enough to permit the person to be restrained to be seated on the fabric section, the top and bottom edges being connected by intermediate edges which angle inwardly between the top and bottom edges, the fabric portion including a first vertical severance line which extends from the midpoint of the top edge a selected distance which is a small portion of the distance between the top and bottom edges, second and third severance lines which extend in opposite directions from the first severance line and substantially follow the peripheral edge of the fabric section to within a relatively small distance of each other near the lower edge, thereby defining first and second tie bands, fourth and fifth severance lines which extend in opposite directions from said first severance line a relatively short distance below said second and third severance lines and parallel said second and third severance lines for a relatively short distance to their termination points, thereby defining third and fourth tie bands, sixth and seventh severance lines which extend in opposite directions from the first severance line a relatively short distance below said fourth and fifth severance lines and are similar to the fourth and fifth severance lines, thereby defining fifth and sixth tie bands, said third and fifth tie bands being in use tied around one portion of the chair, said fourth and sixth tie bands being in use tied around another portion of the chair, and the first and second tie bands being in use tied around the person to be restrained.

10. An article of claim 9, wherein the first and second tie bands are approximately 25 inches long and $1\frac{1}{2}$ inches wide.

11. An article of claim 9, wherein the third, fourth, fifth and sixth tie bands are each approximately 9 inches long and $\frac{3}{4}$ inches wide.

12. An article of claim 9, wherein said fabric section is heart-shaped in outline.

* * * * *